US009657253B2

(12) United States Patent
Schmid et al.

(10) Patent No.: US 9,657,253 B2
(45) Date of Patent: May 23, 2017

(54) TRICRESYL PHOSPHATE-FREE OIL, LUBRICANT OR TURBINE OIL

(71) Applicant: FRAUNHOFER-GESELLSCHAFT ZUR FÖRDERUNG DER ANGEWANDTEN FORSCHUNG E.V., München (DE)

(72) Inventors: Helmut Schmid, Freudenstadt (DE); Wilhelm Eckl, Karlsruhe (DE); Heinz-Jörn Moriske, Gumtow (DE)

(73) Assignee: FRAUNHOFER-GESELLSCHAFT ZUR FÖRDERUNG DER ANGEWANDTEN FORSCHUNG E.V., München (DE)

( * ) Notice: Subject to any disclaimer, the term of this patent is extended or adjusted under 35 U.S.C. 154(b) by 0 days.

(21) Appl. No.: 14/767,826

(22) PCT Filed: Jan. 31, 2014

(86) PCT No.: PCT/EP2014/051935

§ 371 (c)(1),
(2) Date: Aug. 13, 2015

(87) PCT Pub. No.: WO2014/131571

PCT Pub. Date: Sep. 4, 2014

(65) Prior Publication Data

US 2016/0002565 A1 Jan. 7, 2016

(30) Foreign Application Priority Data

Feb. 27, 2013 (DE) ..... 10 2013 003 282

(51) Int. Cl.
*C10M 169/04* (2006.01)

(52) U.S. Cl.
CPC ..... *C10M 169/044* (2013.01); *C10M 169/04* (2013.01); *C10M 2201/053* (2013.01);
(Continued)

(58) Field of Classification Search
CPC ..... C10M 169/044; C10M 169/04; C10M 2201/053; C10M 2205/026;
(Continued)

(56) References Cited

U.S. PATENT DOCUMENTS 3,026,262 A 3/1962 Foster et al.
5,108,634 A 4/1992 Seiki
(Continued)

FOREIGN PATENT DOCUMENTS

DE 10 2005 041 005 A1 3/2007
WO WO 2005/113640 A1 12/2005

OTHER PUBLICATIONS

Aerotoxic Association, Reports and Evidence, http://aerotoxic.org/information/reports-and-evidence/(download Oct. 12, 2015—7 pages).

(Continued)

*Primary Examiner* — Cephia D Toomer
(74) *Attorney, Agent, or Firm* — Leydig, Voit & Mayer, Ltd.

(57) ABSTRACT

The present invention relates to a tricresyl phosphate-free oil which can be used as lubricant or hydraulic oil. The oil is distinguished by extremely low human toxicity. In particular, the oil is suitable as turbine oil, i.e. as lubricant oil in aircraft turbines, with which, in the case of a fume event, symptoms of the aerotoxic syndrome in aircraft passengers can be prevented. In addition, the present invention relates to the corresponding use of the turbine oil according to the invention for the prophylaxis of the aerotoxic syndrome in the case of a fume event. In addition, the invention describes a turbine which contains a corresponding turbine oil as lubricant. Furthermore, the method for operating a turbine is indicated.

19 Claims, 2 Drawing Sheets

(52) U.S. Cl.
CPC ..... *C10M 2205/026* (2013.01); *C10M 2205/0265* (2013.01); *C10M 2207/023* (2013.01); *C10M 2207/026* (2013.01); *C10M 2207/126* (2013.01); *C10M 2207/2815* (2013.01); *C10M 2207/2835* (2013.01); *C10M 2207/401* (2013.01); *C10M 2209/12* (2013.01); *C10M 2209/123* (2013.01); *C10N 2220/082* (2013.01); *C10N 2230/42* (2013.01); *C10N 2230/64* (2013.01); *C10N 2240/08* (2013.01); *C10N 2240/121* (2013.01)

(58) Field of Classification Search
CPC .... C10M 2205/0265; C10M 2207/023; C10M 2207/026; C10M 2207/126; C10M 2207/2815; C10M 2207/2835; C10M 2207/401; C10M 2209/12; C10M 2209/123; C10N 2220/082; C10N 2230/42; C10N 2230/64; C10N 2240/08; C10N 2240/121
See application file for complete search history.

(56) References Cited

U.S. PATENT DOCUMENTS

2003/0181340 A1 9/2003 Botz et al.
2005/0239937 A1 10/2005 Scherer et al.
2011/0003721 A1* 1/2011 Hong ..... B82Y 30/00 508/113
2011/0046027 A1 2/2011 Zhamu et al.
2012/0010111 A1 1/2012 Shibata et al.

OTHER PUBLICATIONS

European Patent Office, International Search Report in International Application No. PCT/EP2014/051935 (Jun. 4, 2014).
European Patent Office, Written Opinion in International Application No. PCT/EP2014/051935 (Jun. 4, 2014).
International Bureau of WIPO, International Preliminary Report on Patentability in International Application No. PCT/EP2014/051935 (Sep. 11, 2015).
German Patent Office, Office Action in German Patent Application No. 10 2013 003 282.2 (Apr. 23, 2013).
German Patent Office, Office Action in German Patent Application No. 10 2013 003 282.2 (Sep. 9, 2014).
German Patent Office, Office Action in German Patent Application No. 10 2013 003 282.2 (May 10, 2016).

* cited by examiner

TRICRESYL PHOSPHATE-FREE OIL, LUBRICANT OR TURBINE OIL

CROSS-REFERENCE TO RELATED APPLICATIONS

This patent application is the U.S. national phase of International Application No. PCT/EP2014/051935, filed on Jan. 31, 2014, which claims the benefit of German Patent Application No. 10 2013 003 282.2, filed Feb. 27, 2013, the disclosures of which are incorporated herein by reference in their entireties for all purposes.

The present invention relates to a tricresyl phosphate-free oil which can be used as lubricant or hydraulic oil. The oil is distinguished by extremely low human toxicity. In particular, the oil is suitable as turbine oil, i.e. as lubricant oil in aircraft turbines, with which, in the case of a fume event, symptoms of the aerotoxic syndrome in aircraft passengers can be prevented. In addition, the present invention relates to the corresponding use of the turbine oil according to the invention for the prophylaxis of the aerotoxic syndrome in the case of a fume event. In addition, the invention describes a turbine which contains a corresponding turbine oil as lubricant. Furthermore, the method for operating a turbine is indicated.

Oils, e.g. lubricants, are complex substance mixtures which have a plurality of components for fulfilling the most varied of tasks. Consequently, the required standards, e.g. DIN 51517, DIN 51502, ISO 6743-6 inter alia—according to the application case—can be fulfilled. The most important components are shown in FIG. 1 in the example of a cooling lubricant.

According to the state of the art, oils, in particular turbine- and hydraulic oils, are generally stabilised chemically with the help of an isomer mixture of tricresyl phosphates (TKP).

Tricresyl phosphates can be present thereby as isomer mixture or as pure substances which are defined as follows:

Tricresyl phosphate (isomer mixture) (CAS no.: 1330-78-5), o,o,o-tricresyl phosphate (CAS no.: 78-30-8) m,m,m-tricresyl phosphate (CAS no.: 563-04-2) or p,p,p-tricresyl phosphate (CAS no.: 78-32-0).

In particular the o-isomers are highly toxic for humans since they inhibit the enzyme cholinesterase. In the extreme case, this can lead to paralysis. Such compounds (phosphoric acid esters) have furthermore further importance in the class of chemical weapons.

In the nowadays current engine- or turbine oils, the previously described tricresyl phosphates are used in particular for aircraft gas turbines, as standard, as stabilisers.

In order to have a comfortable environment and sufficient air pressure in the cabin for breathing, warm compressed air is required at the altitude at which passenger aircraft normally fly. This air is provided by the engine and is thus in contact with moveable parts which are in contact with the turbine oil. There are various gaskets in the engine which are there for the purpose of separating the lubricant oil and the air. Because of their properties, these gaskets cannot be 100% effective and a certain part of the oil is released into the air. They are greatly stressed, become therefore worn, and, like any other mechanical component, can fail. If a large quantity of oil is mixed with the very hot compressed air, vapours or smoke pass into the cabin. This is known as a "fume event". This definition also forms the basis of the terminology of the present invention. There are no filters in the cabin air supply which could prevent this.

A fume event is hence an occurrence in which the air of the cockpit and/or the passenger cabin of an aircraft becomes contaminated by a mist which comprises turbine oil. These events must be reported to the Federal Aviation Office (LBA). The worldwide number of fume events is approx. 230/year, in part with a dramatic result according to investigation reports published by Aerotoxic Association Ltd., London, England.

How turbine oil-containing mist can pass into the passenger cabin is currently still the subject of investigations. Gasket problems are assumed. In the case of hydraulic oils, failure of the return valves is often the cause. The fact is that TKP is used in a content of up to 5% by mass as stabiliser in turbine oils. Furthermore, the fact is that an air flow in the compressor of the turbine is branched off for cabin ventilation because as a result the pressure build-up in the cabin, as is required at high altitude, and the heating can be achieved very easily.

In the case of current engine oils, the case of a fume event is exceptionally alarming from a health point of view since the toxically-acting tricresyl phosphates which are contained in the turbine oils display side-effects when breathed in. These symptoms of poisoning are also known by the term "aerotoxic syndrome".

Under the term of aerotoxic syndrome, possible health damage is discussed, which can be triggered by contamination of the air for breathing in the cabin of passenger aircraft. Mainly problems in the bleed air unit are thereby mentioned as the possible cause of contamination in the air for breathing.

The aerotoxic syndrome is considered as a relatively unexplored syndrome which is still being investigated at present although it has been known in fact since the end of the 1950s. The term originates from 1999 and was introduced by Dr. Harry Hoffman, Professor Chris Winder and Jean Christophe Balouet Ph.D.

The aerotoxic syndrome is distinguished by a wide range of symptoms which can occur after breathing in cabin air contaminated with organophosphates.

The symptoms can occur acutely, for example for a short time after the flight, or chronically. One or more of these following symptoms can occur:

Fatigue—feeling exhausted even after a sleeping phase
Blurred vision or tunnel vision
Shaking and trembling states
Equilibrium disorders
Cramp attacks
Loss of consciousness
Memory impairment
Headaches
Tinnitus
Dazed state, dizziness
Confusion, cognitive difficulties
Poisoned feelings
Sickness, nausea
Diarrhoea
Eye irritations
Vomiting
Coughing
Breathing difficulties (shortness of breath)
Pressure on chest
Failure of respiratory tracts
Increase in heart frequency and heartbeat
Irritation of eyes, nose and upper respiratory tract According to the state of the art, efforts are now being made to use o-low TKP isomers. This in fact reduces the toxicity but does not solve the problem fundamentally. Furthermore, it cannot be expected that, despite greatest efforts, fume events can in the future be prevented in the short term because the operating states and boundary conditions responsible for this are obviously very complex.

Starting herefrom, it was hence the object of the present invention to indicate oils, in particular lubricating-, hydraulic- or turbine oils, which can be used as lubricant for moveable parts of turbines, such as for example gas turbines and in particular drive turbines for aircraft, which have greatly reduced human toxicity and with which, in particular even the case of a fume event and hence introduction of a corresponding oil which is used as turbine oil into the cabin interior of an aircraft, no toxic mists are produced and hence the aerotoxic syndrome can be prevented prophylactically in the case of persons and/or animals located in the aircraft interior. The invention hence sets itself the task of indicating corresponding uses of such a turbine oil and indicating a corresponding turbine which uses a turbine oil according to the invention as lubricant. In addition, it is the object of the present invention to mention a method for operating a turbine. This object is achieved, with respect to an oil, by the features of a turbine oil for the prophylaxis of the aerotoxic syndrome described herein, by the use of an oil composition described herein, by the features and method for operating a turbine described herein, and the advantageous developments thereof. Uses according to the invention are also described.

DETAILED DESCRIPTION OF THE INVENTION

According to the invention, an oil is hence indicated, which is suitable in particular as lubricant, lubricating oil, cooling lubricant, as turbine oil for gas turbines, in particular aircraft turbines, i.e. for example turboprop- or turbofan engines or as hydraulic oil. According to the invention, the oil is thereby free of tricresyl phosphates. There is thereby understood by freedom from tricresyl phosphates that the mentioned tricresyl phosphates are not included in the oil according to the invention at all or below the detection limit of any analytical method with which tricresyl phosphates can be detected. The oil according to the invention thereby comprises at least one basic oil, at least one sort of alkyl polyglycosides and also at least one phenol derivative of general formula I Formula 1

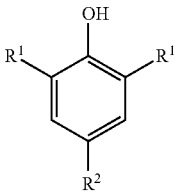

wherein $R^1$ upon each occurrence, is selected, independently of each other, from the group consisting of linear or branched alkyl radicals with 1 to 18 carbon atoms and $R^2$ upon each occurrence, is selected, independently of each other, from the group consisting of hydrogen or linear or branched alkyl radicals with 1 to 18 carbon atoms.

With the invention, the object of replacing the toxic additive TKP by a non-human-toxic phenol derivative of formula I as stabiliser is achieved. A particularly preferred example of this is butylated hydroxytoluenes, in particular 3,5-di-tert.-butyl-hydroxytoluene (BHT). BHT has for example an FDA license.

The phenol derivatives are chemically compatible with lubricant oils and polyols (hydraulic oils) and cause chemical stabilisation as radical interceptors.

Improvement relative to the state of the art resides in the fact that the component BHT described according to the invention can completely replace the toxic TKP components in lubricating oils, turbine oils and hydraulic oils without any negative accompanying occurrences. The dangerous toxic effect for example of fume events, in the case where the oil is used as turbine oil, can consequently be prevented at source.

The crucial advantage of BHT including its derivatives is now that the chemical compatibility with these additives can be adjusted within wide ranges.

In addition, it has been shown that the phenol derivative according to general formula I represents an effective oxidation stabiliser for the oil according to the present invention so that, in the case of a fume event, not only are non-toxic mists produced but also excellent protection is provided for the turbine oil against oxidative decomposition. This effect is explained in more detail subsequently with the example of BHT.

Figure 1:
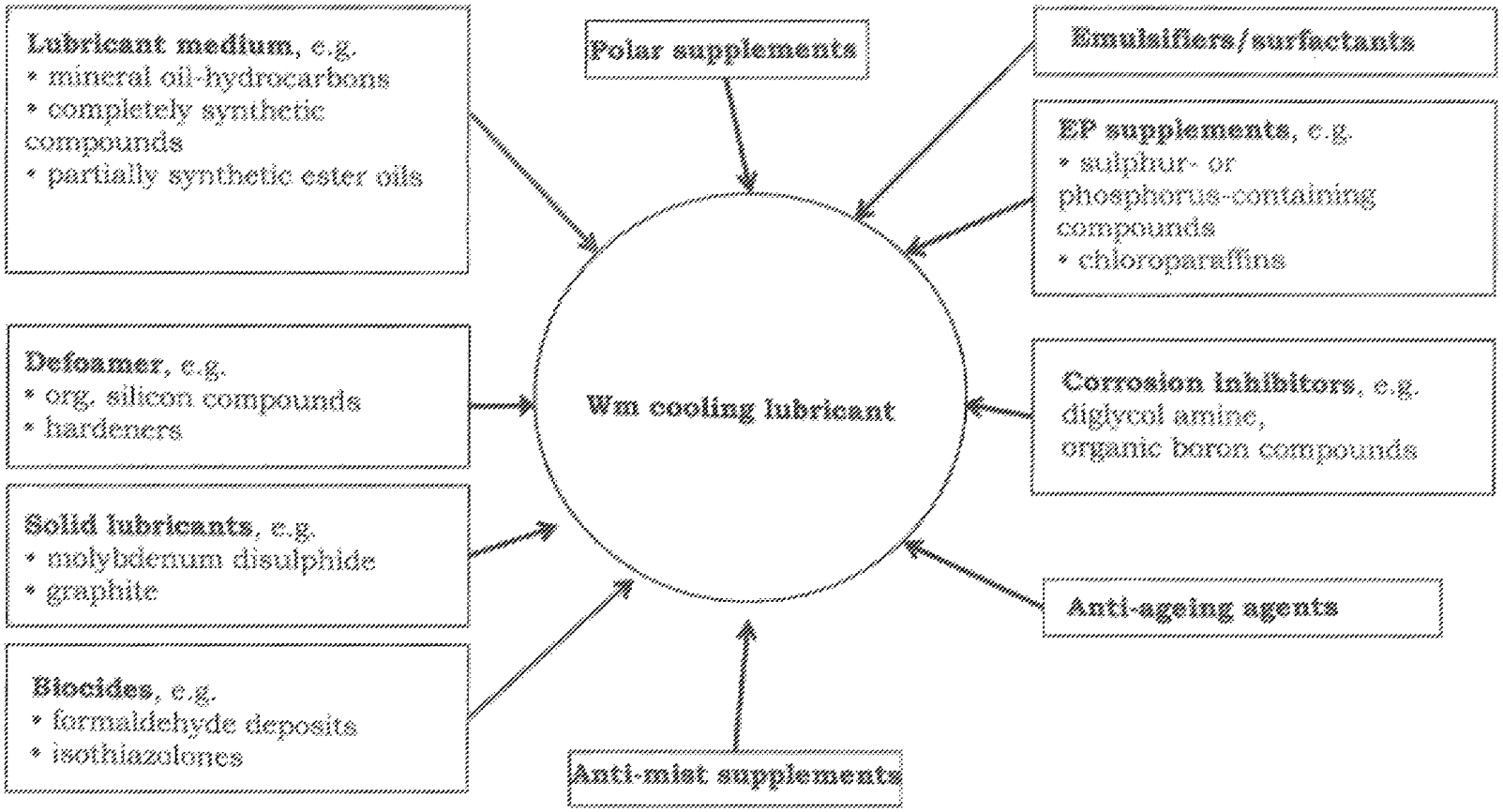
FIG. 1 illustrates the most important components of a cooling lubricant.
Figure 2:
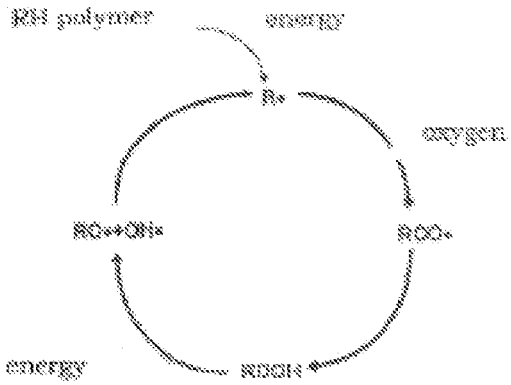
FIG. 2 illustrates the two mechanistic cycles responsible for decomposition of the alkyl component of oils and polyols.
Figure 2:
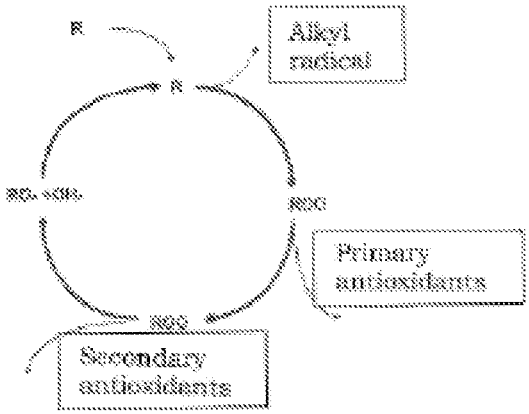

For decomposition of the alkyl component of oils and polyols, mainly two mechanistic cycles are responsible which are illustrated in FIG. 2.

BHT is capable of forming stabilised tert.-butyl radicals and now enters into the second cycle process in the sense of an alkyl radical scavenger and thus prevents a further reaction.

The alkyl polyglycosides contained in the oil according to the invention (image, given by way of example, in the subsequent formula) can be represented, for example in the following way: the starting material for alkyl polyglycoside synthesis is firstly glucose which is obtained from sugar- or starch-providing plants. The raw material for forming the alkyl radical is palm oil. The glycoside production can be effected according to a method illustrated below in the overview. The method parameters are generally chosen such that the polymerisation degree m of the glycoside is 2-4, and the polymerisation degree n of the alkyl radical is 12-14. Corresponding compounds and production methods are already known from the state of the art.

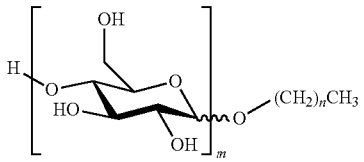

In the oil according to the invention, the alkyl glycosides take over the function of several additives at once: the added alkyl glycosides act, at the same time, as dispersants and detergents.

A further aspect of the invention is therefore aimed towards the function of numerous additives, which are used as detergents, dispersants and for peptisation/solubilisation, being represented by only one substance class of non-ionic alkyl polyglycosides. In the case of these multifunctional molecules, the polyglycoside forms the hydrophilic component, whilst the alkyl radical acts as hydrophobic component. By extension, it is stressed that this substance class is synthesised on the basis of renewable raw materials.

Normal additional assistance in the surface-active effect, e.g. by anionic surfactants, such as Na-lauryl sulphate or triethanol amine lauryl sulphate, can hence be dispensed with.

A preferred embodiment of the oil of the present invention provides that it is entirely free of constituents which are toxic for humans, such as e.g. organic phosphoric acid esters, organic phosphonic acid esters, organic phosphinic acid esters and/or organic or phenyl naphthyl amines.

Here also, the term "free of" is understood such that the mentioned substances are contained either not at all in the oil or in quantities which are below the detection limit of any analytical method for detecting such substances in oils.

Furthermore, it is preferred if the general compound of formula I is selected from the group consisting of 3,5-di-tert.-butyl-hydroxytoluene (BHT), 2,4-dimethyl-6-tert-butyl phenol, 2,6-di-tert-butyl phenol and also mixtures or combinations hereof. 3,5-di-tert.-butyl-hydroxytoluene (BHT) is hereby particularly preferred.

The phenol derivative according to formula I can be contained in the oil in quantities of 0.01 to 10% by weight, preferably of 0.1 to 7.5% by weight, further preferred of 0.25 to 5% by weight, in particular of 0.5 to 1.5% by weight, relative to the total oil.

In addition, it is preferred if the basic oil forming the basis of the oil represents a synthetic oil and is selected in particular from the group consisting of polyol esters, in particular trimethylolpropane trinonanoate. Likewise possible are carboxylic acid esters of long-chain fatty acids, i.e. fatty acids with at least eight carbon atoms, such as for example decanoic acid methyl ester. Vegetable oils are likewise suitable, such as for example rapeseed oil. According to the purpose of use, different oils can hereby be used. In the case where the oil according to the invention is intended to be used as turbine oil, the previously mentioned polyol esters are preferred. For hydraulic fluids, preferably the long-chain carboxylic acid esters are used, however, natural oils are likewise suitable. As cooling lubricants, preferably natural oils, such as for example rapeseed oil, are used. The compositions based on natural oils, such as for example rapeseed oil, are distinguished by extremely high environmental friendliness.

Relative to the totality of the oil, the basic oil can constitute a quantity proportion of 99.799 to 30% by weight, preferably of 88.9 to 40% by weight, further preferred of 79.75 to 50% by weight, in particular of 67.5 to 58.5% by weight.

A further preferred embodiment provides that nanosilver particles are contained in the oil, preferably of 0.1 to 10 ppm, in particular of 0.1 to 1 ppm, preferably the average particle size of the nanosilver particles being of 1 to 100 nm, preferably 5 to 15 nm. Such nanoparticles are described for example in DE 10 2005 041 005 A1. With respect to these silver particles and also production thereof, reference is made explicitly to the previously mentioned publication.

In addition, it is possible that the turbine oil comprises further special additives which are selected from the group consisting of polyisobutylenes, fatty acids, in particular stearic acid and/or combinations hereof.

In the case of further additivation of the oil, the previously mentioned additives are thereby contained in a quantity of 0.1 to 30% by weight, preferably of 5 to 25% by weight, further preferred of 10 to 20% by weight, in particular of 12.5 to 17.5% by weight, relative to the total turbine oil.

A special and particularly preferred composition of an oil according to the invention thereby has the following formulation:

a) 99.799 to 30% by weight, preferably of 88.9% to 40% by weight, further preferred of 79.75 to 50% by weight, in particular of 72 to 58.5% by weight, of at least one basic oil, b) 0.01 to 10% by weight, preferably of 0.1 to 7.5% by weight, further preferred of 0.25 to 5% by weight, in particular of 0.5 to 1.5% by weight, of at least one phenol derivative of the general formula I, c) 0.1% to 30%, preferably 5 to 27.5% by weight, further preferred 10 to 25% by weight, in particular 15 to 22.5% by weight, of at least one sort of alkyl polyglycosides, and also d) 0.1 to 30% by weight, preferably of 5 to 25% by weight, further preferred of 10 to 20% by weight, in particular of 12.5 to 17.5%, of at least one additive, selected from the group consisting of alkyl polyglycosides, polyisobutylenes, fatty acids, in particular stearic acid and/or combinations hereof, the quantities of components a) to d) being chosen such that 100% by weight results.

It is hereby particularly advantageous that the weight ratio of the used additives alkylpolyglycosides:polyisobutylene: fatty acids is in a weight ratio of 25:40:35 to 75:50:5, preferably of 40:35:25 to 65:25:10, particularly preferred of 45:35.5:19.5 to 55:30.5:14.5.

The invention relates in particular to a turbine oil, e.g. for gas turbines, a hydraulic oil or a cooling lubricant based on a previously described oil.

The previously mentioned turbine oil serves in particular for the prophylaxis of the aerotoxic syndrome in the case of a fume event when used as lubricant or lubricating oil in aircraft turbines.

Surprisingly, it could be established that, with a turbine oil according to the invention in the case of a fume event, i.e. in the case where a turbine oil according to the invention passes into the cabin interior, such as for example the cockpit or the passenger cabin of an aircraft, in nebulous form, the symptoms of the aerotoxic syndrome can be prevented prophylactically.

The invention relates in addition to the use of a tricresyl phosphate-free oil, described further back, as lubricant or lubricating oil or turbine oil for aircraft turbines, for the prophylaxis of the aerotoxic syndrome in the case of a fume event.

The use according to the invention of the turbine oil thereby likewise refers back to all previously mentioned aspects which were discussed in connection with the oil according to the invention.

The invention relates in addition to a turbine, in particular a gas turbine and particularly preferred a turbine assembly for aircraft, for example turboprop- or turbofan turbines, which includes a previously described oil as lubricant, lubricating oil or turbine oil, in particular for the prophylaxis of the aerotoxic syndrome in the case of a fume event, or in which a corresponding turbine oil is used in particular for the mentioned purposes.

Furthermore, the present invention relates to a method for operating a turbine, for example a gas turbine and in particular an aircraft turbine, such as for example a turbo prop- or turbofan engine, in which a previously mentioned turbine oil is used for the prophylaxis of the aerotoxic syndrome in the case of a fume event.

The present invention is explained in more detail with reference to the subsequent explanations and embodiments without however restricting the invention to the specially illustrated parameters.

Example 1

For the practice-orientated application case, a turbine oil with a basic composition in which the TKP components (of comparable commercially available turbine oils) are replaced by the same content of BHT.

The high-performance turbine oil forming the basis of example 1 thereby has the following composition:

Turbine Oil

Basic Composition

| | | Content |
|---|---|---|
| Basic component | polyol esters, triesters: trinonanoic acid trimethylol propane esters | 92.0% |
| Stabiliser | BHT | 2.0% |
| Emulsifier | alkyl polyglycosides as described | 1.0% |
| Solubility promoter | " | 1.0% |
| Defoamer | " | 1.0% |
| Anticorrosion | PEG 200 | 1.0% |
| Antimicrobial system | nano Ag | 10.0 ppm |
| Friction-reducing agent | stearic acid | 1.0% |
| Vi enhancer | polyisobutylene 5000 | 1.0% |

This example represents a formulation for a high-performance turbine oil which takes into account the chemical integration capacity and compatibility of BHT in a particular way.

A polyol ester is selected as basic oil since, in comparison with the possible alternatives for the high requirements of a turbine oil, this shows the best performance.

Hence the following properties can be achieved:

As is evident from the above Table, the turbine oil composition according to the invention satisfies the minimum requirements for licensing an oil as turbine oil. The oxidation resistance and also the low toxicity of such an oil are thereby particularly advantageous.

Examples 4-6

In addition, the same principles can be applied also for hydraulic oils and cooling lubricants. Subsequently, basic formulations are also indicated for this purpose.

Example 4

Hydraulic Fluid not Readily Flammable of the HFD-type DIN 51 502, VDMA 24317 optimised with respect to compressibility, lubrication properties, T-specific viscosity change, flash point, pour point, stability Basic Composition

| | | Content |
|---|---|---|
| Basic component | decanoic acid methyl ester | 94.0% |
| Stabiliser | BHT | 2.0% |
| Emulsifier | alkyl polyglycosides as described | 1.0% |
| Solubility promoter | " | 1.0% |
| Defoamer | " | 1.0% |
| Anticorrosion | PEG 200 | 1.0% |
| Antimicrobial system | nano AG | 10.0 ppm |

Example 5

Hydraulic Fluid, Environmentally Friendly of the HETG-type (DIN ISO 15380, VDMA 24568)

optimised with respect to compressibility, lubrication properties, T-specific viscosity change, pour point, stability General Standard according to MIL-PRF-23699F

| | | | Requirement | |
|---|---|---|---|---|
| Kinematic viscosity | 40° | ISO 3104 | min. 23 | 25 [$mm^2/s$] |
| | 100° | ISO 3104 | 4.9-5.4 | 5 [mm2/s] |
| | −40° | ASTM D 2532 | max. 13,000 | 9,000 [$mm^2/s$] |
| Pour Point | | ASTM D97 | max. −54 | −60 [° C.] |
| Flash Point | | ASTM D92 | | 270 [° C.] |
| Fire Point | | ISO 2592 | | 285 [° C.] |
| Auto Ignition T | | | | 400 [° C.] |
| Density | 15° C. | ASTM D4052 | | 1.00 [kg/l] |
| Total Acid Number (TAN) | | | max. 1 | 0.03 [mg KOH/g sample] |
| Evaporation Loss | 6.5 h, 204° C., 0.039 bar | | max. 10 | 3 [%] |
| | 6.5 h, 232° C., 0.039 bar | | | 11 [%] |
| | 6.5 h, 232° C., 0.0073 bar | | | 34 [%] |
| Foam Volume | 24° C. | | | 8 [ml] |
| | 93.5° C. | | | 10 [ml] |
| | 75.0° C. | | | 8 [ml] |
| Foam Stability | 1 min settling | | | 0 [ml] |
| Rubber Swell | 72 h, 204° C. | SAE-AMS 3217/4 | 5-25 | 16 [%] |
| | 72 h, 70° C. | SAE-AMS 3217/1 | 5-25 | 16 [%] |
| Sonic Shear stability (Viscosity Change) | 40% | ASTM D5621<br>DIN 51382<br>CEC L45-A-99 | max. 4 | 0.9 [%] |
| Ryder Gear Test | Tooth Normal Force | DIN 51354<br>CEC L-07-A-71 | | 500 [N/mm] |

Basic Composition

| | | Content |
|---|---|---|
| Basic component | Rapeseed oil | 94.0% |
| Stabiliser | BHT | 2.0% |
| Emulsifier | alkyl polyglycosides as described | 1.0% |
| Solubility promoter | " | 1.0% |
| Defoamer | " | 1.0% |
| Anticorrosion | PEG 200 | 1.0% |
| Antimicrobial system | nano AG | 10.0 ppm |

Example 6

KSS Cooling Lubricant water-dilutable concentrate for emulsion production required contents according to machining task 5-10% frame composition

| | | Content |
|---|---|---|
| Basic component | Rapeseed oil | 58.0% |
| Stabiliser | BHT | 2.0% |
| Emulsifier | alkyl polyglycosides as described | 20.0% |
| Solubility promoter | " | 9.0% |
| Defoamer | " | 1.0% |
| Anticorrosion | Na sulphonate | 10.0% |
| Antimicrobial system | nano AG | 10.0 ppm |

Reference is made expressly to the fact that—in contrast to the state of the art—all the formulations dispense with toxic compounds of B, N (amines), P, S and halogens.

The invention claimed is:

1. A tricresyl phosphate-free oil composition, comprising a) at least one basic oil, b) at least one alkyl polyglycoside, and c) at least one phenol derivative of general formula I Formula 1

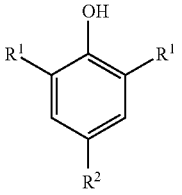

wherein $R^1$ upon each occurrence, is selected, independently of each other, from the group consisting of linear or branched alkyl radicals with 1 to 18 carbon atoms and $R^2$ upon each occurrence, is selected, independently of each other, from the group consisting of hydrogen or linear or branched alkyl radicals with 1 to 18 carbon atoms.

2. The tricresyl phosphate-free oil composition according to claim 1, which is free of organic phosphoric acid esters, organic phosphonic acid esters, organic phosphinic acid esters, and/or organic phosphane oxides and/or naphthyl amines.

3. The tricresyl phosphate-free oil composition according to claim 1, wherein the general compound of formula I is selected from the group consisting of 3,5-di-tert.-butylhydroxytoluene (BHT), 2,4-dimethyl-6-tert-butyl phenol, 2,6-di-tert-butyl phenol and mixtures or combinations thereof.

4. The tricresyl phosphate-free oil composition according to claim 1, wherein the compound of formula I is contained in a quantity of 0.01 to 10% by weight relative to the total oil.

5. The tricresyl phosphate-free oil composition according to claim 1, wherein the basic oil is selected from the group consisting of polyol esters, carboxylic acid esters, and natural oils.

6. The tricresyl phosphate-free oil composition according to claim 1, wherein the basic oil is contained in a quantity of 99.799 to 30% by weight relative to the total oil.

7. The tricresyl phosphate-free oil composition according to claim 1, wherein further nanosilver particles are contained, in a quantity of 0.01 to 50 ppm and/or the average particle size of the nanosilver particles is 1 to 100 nm.

8. The tricresyl phosphate-free oil composition according to claim 1, wherein further additives selected from the group consisting of polyisobutylenes, fatty acids, or combinations thereof, are contained in a quantity of 0.1 to 30% by weight relative to the total oil.

9. The tricresyl phosphate-free oil composition according to claim 1, having the following composition:

a) 99.799 to 30% by weight of at least one basic oil, b) 0.01 to 10% by weight of at least one phenol derivative of general formula I, c) 0.1% to 30% by weight of at least one alkyl polyglycoside and d) 0.1 to 30% by weight, of at least one further additive, selected from the group consisting of polyisobutylenes, fatty acids, stearic acid and/or combinations thereof, the quantities of components a) to d) being chosen such that 100% by weight results.

10. The tricresyl phosphate-free oil composition according to claim 9, wherein the weight ratio of alkyl polyglycosides:polyisobutylenes:fatty acids is of 25:40:35 to 75:50:5.

11. The tricresyl phosphate-free oil composition according to claim 1, in the form of a turbine oil.

12. A method for lubricating aircraft turbines for the prophylaxis of the aerotoxic syndrome in the case of a fume event comprising utilizing the tricresyl phosphate-free oil composition of claim 1.

13. The method according to claim 12, wherein the aerotoxic syndrome comprises at least one or more of the following symptoms: blurred vision or tunnel vision, shaking and trembling states, equilibrium disorders, cramp attacks, loss of consciousness, memory impairment, headaches, tinnitus, dazed state, dizziness, confusion, cognitive difficulties, poisoned feelings, sickness, nausea, diarrhea, eye irritations, vomiting, coughing, breathing difficulties (shortness of breath), pressure on chest, failure of respiratory tract, increase in heart frequency and heartbeat and/or and irritation of eyes, nose and upper respiratory tract.

14. A turbine, containing an oil composition according to claim 1 as lubricant or lubricating oil.

15. A method for operating a turbine comprising utilizing an oil composition according to claim 1 as lubricant or lubricating oil.

16. The tricresyl phosphate-free oil composition according to claim 4, wherein the compound of formula I is contained in a quantity of 0.1 to 7.5% by weight relative to the total oil.

17. The tricresyl phosphate-free oil composition according to claim 5, wherein the basic oil is selected from the group consisting of trimethylolpropane trinonanoate, decanoic acid methyl ester, and rapeseed oil.

18. The tricresyl phosphate-free oil composition according to claim 6, wherein the basic oil is contained in a quantity of 88.9 to 40% by weight relative to the total oil.

19. The tricresyl phosphate-free oil composition according to claim 7, wherein the further nanosilver particles are contained in a quantity of 0.1 to 10 ppm and/or the average particle size of the nanosilver particles is 5 to 15 nm.

* * * * *